US011499430B2

(12) United States Patent
Kitada et al.

(10) Patent No.: US 11,499,430 B2
(45) Date of Patent: Nov. 15, 2022

(54) TURBINE ROTOR BLADE, TURBINE, AND TIP CLEARANCE MEASUREMENT METHOD

(71) Applicant: Mitsubishi Power, Ltd., Kanagawa (JP)

(72) Inventors: Hiroki Kitada, Yokohama (JP); Satoshi Hada, Yokohama (JP); Hiroyuki Otomo, Yokohama (JP); Yasumasa Kunisada, Yokohama (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 9 days.

(21) Appl. No.: 17/281,003

(22) PCT Filed: Nov. 20, 2019

(86) PCT No.: PCT/JP2019/045349
§ 371 (c)(1),
(2) Date: Mar. 29, 2021

(87) PCT Pub. No.: WO2020/116155
PCT Pub. Date: Jun. 11, 2020

(65) Prior Publication Data

US 2021/0340877 A1 Nov. 4, 2021

(30) Foreign Application Priority Data

Dec. 6, 2018 (JP) ..... JP2018-228937

(51) Int. Cl.
*F01D 5/14* (2006.01)
*F01D 5/18* (2006.01)

(52) U.S. Cl.
CPC ..... *F01D 5/141* (2013.01); *F01D 5/18* (2013.01); *F01D 5/187* (2013.01);
(Continued)

(58) Field of Classification Search
CPC . F01D 5/187; F01D 5/141; F01D 5/18; F01D 21/003; F05D 2220/32; F05D 2240/30; F05D 2260/20
See application file for complete search history.

(56) References Cited

U.S. PATENT DOCUMENTS 6,190,129 B1 * 2/2001 Mayer ..... F01D 5/187 416/235
7,891,938 B2 * 2/2011 Herron ..... F01D 5/20 415/173.2

(Continued)

FOREIGN PATENT DOCUMENTS

CA 2204693 C * 3/2007 ..... F01D 11/025
JP 2013-529740 7/2013

(Continued)

OTHER PUBLICATIONS

International Search Report dated Feb. 4, 2020 in International Application No. PCT/JP2019/045349, with English-language translation.

(Continued)

*Primary Examiner* — Igor Kershteyn
*Assistant Examiner* — Brian Christopher Delrue
(74) *Attorney, Agent, or Firm* — Wenderoth, Lind & Ponack, L.L.P.

(57) ABSTRACT

A turbine rotor blade includes: a root portion fixed to a rotor shaft; and an airfoil portion including a pressure surface, a suction surface, and a top surface connecting the pressure surface and the suction surface, with a cooling passage formed inside the airfoil portion. The top surface of the turbine rotor blade includes a leading edge region located on the leading edge side and formed parallel to the rotor shaft, and a trailing edge region adjacent to the leading edge
(Continued)

region. The trailing edge region has an inclined surface inclined radially inward toward a trailing edge.

18 Claims, 11 Drawing Sheets

(52) U.S. Cl.
CPC ..... *F05D 2220/32* (2013.01); *F05D 2240/30* (2013.01); *F05D 2260/20* (2013.01)

(56) References Cited

U.S. PATENT DOCUMENTS

| | | | | |
|---|---|---|---|---|
| 8,753,087 | B2 * | 6/2014 | Shibukawa | F01D 5/22 416/196 R |
| 9,765,628 | B2 * | 9/2017 | Miyoshi | F01D 5/20 |
| 10,041,371 | B1 * | 8/2018 | DeAscanis | H04N 7/18 |
| 10,808,539 | B2 * | 10/2020 | Narrow | F04D 29/526 |
| 10,961,854 | B2 * | 3/2021 | Jennings | F01D 5/186 |
| 2009/0324422 | A1 * | 12/2009 | Klasing | F01D 5/20 416/233 |
| 2010/0043576 | A1 * | 2/2010 | Craig | G01B 21/16 73/866.5 |
| 2010/0111704 | A1 * | 5/2010 | Hada | F01D 5/20 416/97 R |
| 2013/0156559 | A1 * | 6/2013 | Perrot | F04D 29/547 415/185 |
| 2015/0377053 | A1 * | 12/2015 | Mattschas | F01D 11/12 415/173.4 |
| 2018/0023396 | A1 * | 1/2018 | Narrow | F01D 5/143 60/805 |

FOREIGN PATENT DOCUMENTS

| | | |
|---|---|---|
| JP | 2016-84730 | 5/2016 |
| WO | 2010/050261 | 5/2010 |

OTHER PUBLICATIONS

International Preliminary Report on Patentability dated Jun. 17, 2021 in International Application No. PCT/JP2019/045349, with English language translation.

* cited by examiner

TURBINE ROTOR BLADE, TURBINE, AND TIP CLEARANCE MEASUREMENT METHOD

TECHNICAL FIELD

The present disclosure relates to a turbine rotor blade, a turbine, and a tip clearance measurement method.

BACKGROUND

The size of a gap (hereinafter, referred to as "tip clearance") between a stationary wall surface of a turbine casing and a top surface of a turbine rotor blade in a turbine changes due to thermal deformation and centrifugal force deformation of the turbine rotor blade. Patent Document 1 discloses an example of the tip shape of the turbine rotor blade according to deformation of the turbine rotor blade.

CITATION LIST

Patent Literature

Patent Document 1: JP2016-84730A

SUMMARY

Problems to be Solved

During operation of the gas turbine, it is desired to select an appropriate tip clearance to suppress the leak flow at the turbine rotor blade tip in order to improve the performance of the gas turbine.

At least one embodiment of the present invention was made in view of the above typical problem, and an object thereof is to provide a turbine rotor blade with an appropriate tip clearance, a turbine, and a tip clearance measurement method.

Solution to the Problems (1) A turbine rotor blade according to at least one embodiment of the present invention comprises: a root portion fixed to a rotor shaft; and an airfoil portion including a pressure surface, a suction surface, and a top surface connecting the pressure surface and the suction surface, with a cooling passage formed inside the airfoil portion. The top surface includes a leading edge region located on a leading edge side and formed parallel to the rotor shaft, and a trailing edge region adjacent to the leading edge region. The trailing edge region has an inclined surface inclined radially inward toward a trailing edge.

During operation of the gas turbine (high-temperature state where the temperature of the turbine rotor blade rises), the turbine rotor blade deforms due to centrifugal force, force received from the gas flow, and thermal expansion. In particular, the temperature of a coolant flowing through the cooling passage tends to increase in the vicinity of the trailing edge of the turbine rotor blade, so that thermal expansion tends to be significant in the vicinity of the trailing edge. Accordingly, if the tip clearance between the top surface of the turbine rotor blade and the stationary wall surface of the turbine casing is set constant from the leading edge to the trailing edge when the operation of the gas turbine is stopped (state where the temperature of the turbine rotor blade does not rise and is close to room temperature), the risk of contact between the top surface of the turbine rotor blade and the stationary wall surface of the turbine casing increases at the trailing edge which tends to thermally expand when the gas turbine is operated. However, if the tip clearance is increased uniformly from the leading edge to the trailing edge to prevent contact between the top surface of the turbine rotor blade and the stationary wall surface of the turbine casing on the trailing edge side, the tip clearance is excessively increased on the leading edge side during operation of the gas turbine, so that the performance of the gas turbine decreases.

With the above configuration (1), the trailing edge region disposed on the trailing edge side which tends to thermally expand has an inclined surface inclined radially inward toward the trailing edge. Accordingly, when the trailing edge region largely deforms compared to the leading edge region during operation of the gas turbine, the tip clearance is made uniform over the top surface.

(2) A turbine rotor blade according to at least one embodiment of the present invention comprises: a root portion fixed to a rotor shaft; and an airfoil portion including a pressure surface, a suction surface, and a top surface connecting the pressure surface and the suction surface, with a cooling passage formed inside the airfoil portion. The top surface includes a leading edge region located on a leading edge side and a trailing edge region adjacent to the leading edge region. The trailing edge region has an inclined surface inclined with respect to the leading edge region radially inward toward a trailing edge. On the top surface, when P1 is a position of an intersection between the suction surface and a boundary line between the leading edge region and the trailing edge region, and P2 is a position on the suction surface at which a throat is formed between the suction surface and a trailing edge of an adjacent turbine rotor blade, the position P1 coincides with the position P2 or is located between the position P2 and the trailing edge of the airfoil portion.

With the above configuration (2), in the case of the turbine rotor blade which largely deforms in the trailing edge region compared to the leading edge region due to thermal expansion of the blade tip, the risk of contact with the stationary wall surface of the turbine casing is reduced, so that an appropriate tip clearance can be maintained.

(3) In some embodiments, in the above configuration (1), on the top surface, when P1 is a position of an intersection between the suction surface and a boundary line between the leading edge region and the trailing edge region, and P2 is a position on the suction surface at which a throat is formed between the suction surface and a trailing edge of an adjacent turbine rotor blade, the position P1 coincides with the position P2, or the position P1 is located between the position P2 and the trailing edge.

As in the above configuration (3), when the position P1 coincides with the position P2 or is located between the position P2 and the trailing edge, an appropriate tip clearance can be maintained.

(4) In some embodiments, in the above configuration (2) or (3), the top surface has at least one outlet opening centered at a position P3. On the top surface, a first virtual line located on the leading edge side and passing through the position P2 and a second virtual line located on the trailing edge side and passing through the position P3 are selected. The first virtual line is located in a range defined by a first circumferential virtual line passing through the position P2 and extending in a circumferential direction, a first camber perpendicular virtual line passing through the position P2 and extending in a direction perpendicular to a camber line, and a first rotor axial virtual line passing through the position P2 and extending in a rotor axial direction. The second virtual line is located in a range defined by a second circumferential virtual line passing through the position P3 and extending in the circumferential direction, a second camber perpendicular virtual line passing through the position P3 and extending in the direction perpendicular to the camber line, and a second rotor axial virtual line passing through the position P3 and extending in the rotor axial direction. The boundary line is a straight line passing through the position P1 and is formed on the top surface between the first virtual line and the second virtual line.

(5) In some embodiments, in the above configuration (4), when P4 is a position of an intersection between the suction surface and the second circumferential virtual line, the position P1 is located between the position P4 and the leading edge of the airfoil portion.

In the vicinity of the outlet opening of the cooling passage closest to the trailing edge, particularly, thermal expansion tends to be significant, so that the risk of contact between the top surface and the stationary wall surface increases. Therefore, as in the above configuration (5), when the position P1 is located between the position P4 and the leading edge, the leak flow of combustion gas from the top surface of the turbine rotor blade can be suppressed while effectively reducing the contact risk between the top surface and the stationary wall surface in the vicinity of the outlet opening.

(6) In some embodiments, in the above configuration (4), when P5 is a position of an intersection between the suction surface and the second camber perpendicular virtual line, the position P1 is located between the position P5 and the leading edge of the airfoil portion.

In the vicinity of the outlet opening of the cooling passage closest to the trailing edge, particularly, thermal expansion tends to be significant. Therefore, as in the above configuration (6), when the position P1 is located between the position P5 and the leading edge, an appropriate tip clearance can be maintained in the vicinity of the outlet while effectively reducing the contact risk between the top surface and the stationary wall surface.

(7) In some embodiments, in the above configuration (4), when P6 is a position of an intersection between the suction surface and the rotor axial virtual line, the position P1 is located between the position P6 and the leading edge of the airfoil portion.

In the vicinity of the outlet opening of the cooling passage closest to the trailing edge, particularly, thermal expansion tends to be significant. Therefore, as in the above configuration (7), when the position P1 is located between the position P6 and the leading edge, an appropriate tip clearance can be maintained in the vicinity of the outlet while effectively reducing the contact risk between the top surface and the stationary wall surface.

(8) In some embodiments, in any one of the above configurations (2) to (7), the boundary line extends along a direction perpendicular to the rotor shaft.

When the top surface of the turbine rotor blade is configured such that the boundary line between the leading edge region and the trailing edge region extends along the circumferential direction which is perpendicular to the rotor shaft, the boundary line can be easily formed.

(9) In some embodiments, in any one of the above configurations (2) to (7), the boundary line extends along an axial direction of the rotor shaft.

When the top surface of the turbine rotor blade is configured such that the boundary line between the leading edge region and the trailing edge region extends along the axial direction of the rotor shaft, the boundary line can be easily formed.

(10) In some embodiments, in any one of the above configurations (2) to (7), the boundary line extends along a direction perpendicular to a camber line.

When the top surface of the turbine rotor blade is configured such that the boundary line between the leading edge region and the trailing edge region extends along the direction perpendicular to the camber line, the boundary line can be easily formed.

(11) In some embodiments, in any one of the above configurations (1) to (10), a protrusion protruding radially outward from the top surface is formed along a blade surface at a suction-side end portion of the top surface in a circumferential direction, and a height of a top portion of the protrusion from the top surface in a radial direction is constant from the leading edge to the trailing edge.

When the top surface of the turbine rotor blade has a protrusion at the suction-side end portion of the top surface, the leak flow on the top surface is further reduced, and the aerodynamic performance of the turbine is improved.

(12) In some embodiments, in any one of the above configurations (1) to (11), the airfoil portion includes a top plate forming the top surface. The thickness of the top plate increases toward the trailing edge in a range corresponding to at least a part of the leading edge region, and the thickness of the top plate decreases toward the trailing edge in a range corresponding to at least a part of the trailing edge region.

With the above configuration (12), the temperature in the leading edge region and the trailing edge region is made uniform, so that the increase in the metal temperature of the top plate is suppressed.

(13) In some embodiments, in any one of the above configurations (1) to (12), the airfoil portion includes a top plate forming the top surface. The top plate is formed so as to have the same thickness in the leading edge region and the trailing edge region.

With the above configuration (13), since the thickness of the top plate is uniform from the leading edge region to the trailing edge region, the occurrence of thermal stress in the top plate can be suppressed.

(14) In some embodiments, in any one of the above configurations (1) to (13), the airfoil portion includes a top plate forming the top surface. The cooling passage includes a serpentine passage arranged from the leading edge side to the trailing edge side. A radially outer end portion of the serpentine passage includes at least one return portion for reversing a flow. A wall surface of the top plate opposite to the top surface includes at least one return portion forming wall surface forming the at least one return portion. The at least one return portion forming wall surface is inclined radially inward toward the trailing edge.

With the above configuration (14), even when the inclined surface inclined radially inward toward the trailing edge is formed, since the return portion forming wall surface is inclined radially inward toward the trailing edge, the thickness of the top plate is uniform, so that the occurrence of thermal stress can be suppressed.

(15) In some embodiments, in any one of the above configurations (1) to (14), the airfoil portion includes a top plate forming the top surface. The cooling passage includes a serpentine passage arranged from the leading edge side to the trailing edge side. A radially outer end portion of the serpentine passage includes a first return portion and a second return portion for reversing a flow. A wall surface of the top plate opposite to the top surface includes a first return portion forming wall surface forming the first return portion, and a second return portion forming wall surface forming the second return portion and adjacent to the trailing edge side of the first return portion forming wall surface, with a partition wall interposed between the first and second return portion forming wall surfaces. Each of the first return portion forming wall surface and the second return portion forming wall surface is formed parallel to the rotor shaft. A height of the first return portion forming wall surface from the rotor shaft is more than a height of the second return portion forming wall surface from the rotor shaft.

With the above configuration (15), even when the inclined surface inclined radially inward toward the trailing edge is formed, since the height of the first return portion forming wall surface from the rotor shaft is more than the height of the second return portion forming wall surface from the rotor shaft, the thickness of the top plate is uniform, so that the occurrence of thermal stress can be suppressed.

(16) A turbine according to at least one embodiment of the present invention comprises: a rotor shaft; the turbine rotor blade described in any one of the above (1) to (15); and an annular stationary wall surface facing the top surface of the turbine rotor blade.

With the above configuration (16), since the turbine rotor blade described in any one of the above (1) to (15) is included, the tip clearance can be made uniform, and the loss due to the leak flow in the clearance between the top surface and the stationary wall surface can be effectively reduced.

(17) A tip clearance measurement method according to at least one embodiment of the present invention is for measuring a tip clearance between a top surface of a turbine rotor blade and a stationary wall surface of a turbine. The top surface includes a leading edge region located on a leading edge side and formed parallel to the stationary wall surface, and a trailing edge region inclined such that a distance from the stationary wall surface increases toward a trailing edge. The tip clearance measurement method comprises a leading edge region measurement step of measuring a tip clearance between the leading edge region and the stationary wall surface.

With the above method (17), the trailing edge region disposed on the trailing edge side which tends to thermally expand has an inclined surface inclined such that the distance from the stationary wall surface increases toward the trailing edge. Accordingly, when the trailing edge region deforms mainly during operation of the gas turbine, the tip clearance is made uniform over the top surface.

In addition, since the leading edge region is formed parallel to the rotor shaft, the tip clearance is uniform over the leading edge region. Accordingly, in the leading edge region measurement step to measure the tip clearance in the leading edge region, the tip clearance can be measured accurately regardless of the position in the leading edge region, and the tip clearance can be easily managed.

(18) In some embodiments, in the above method (17), the leading edge region measurement step includes measuring the tip clearance between the leading edge region and the stationary wall surface from a suction side of the turbine rotor blade.

With the above method (18), by inserting a measurement tool such as a taper gauge into the clearance between the top surface and the stationary wall surface from the suction side of the turbine rotor blade, the tip clearance can be measured accurately.

Advantageous Effects

According to at least one embodiment of the present invention, it is easy to set the tip clearance appropriately, and the loss due to the leak flow in the tip clearance can be reduced, so that the thermal efficiency of the gas turbine is improved.

DETAILED DESCRIPTION

Embodiments of the present invention will now be described in detail with reference to the drawings. It is intended, however, that unless particularly identified, dimensions, materials, shapes, relative positions, and the like of components described in the embodiments shall be interpreted as illustrative only and not intended to limit the scope of the present invention.

For instance, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", "have", "contain" and "constitute" are not intended to be exclusive of other components.

Figure 1:
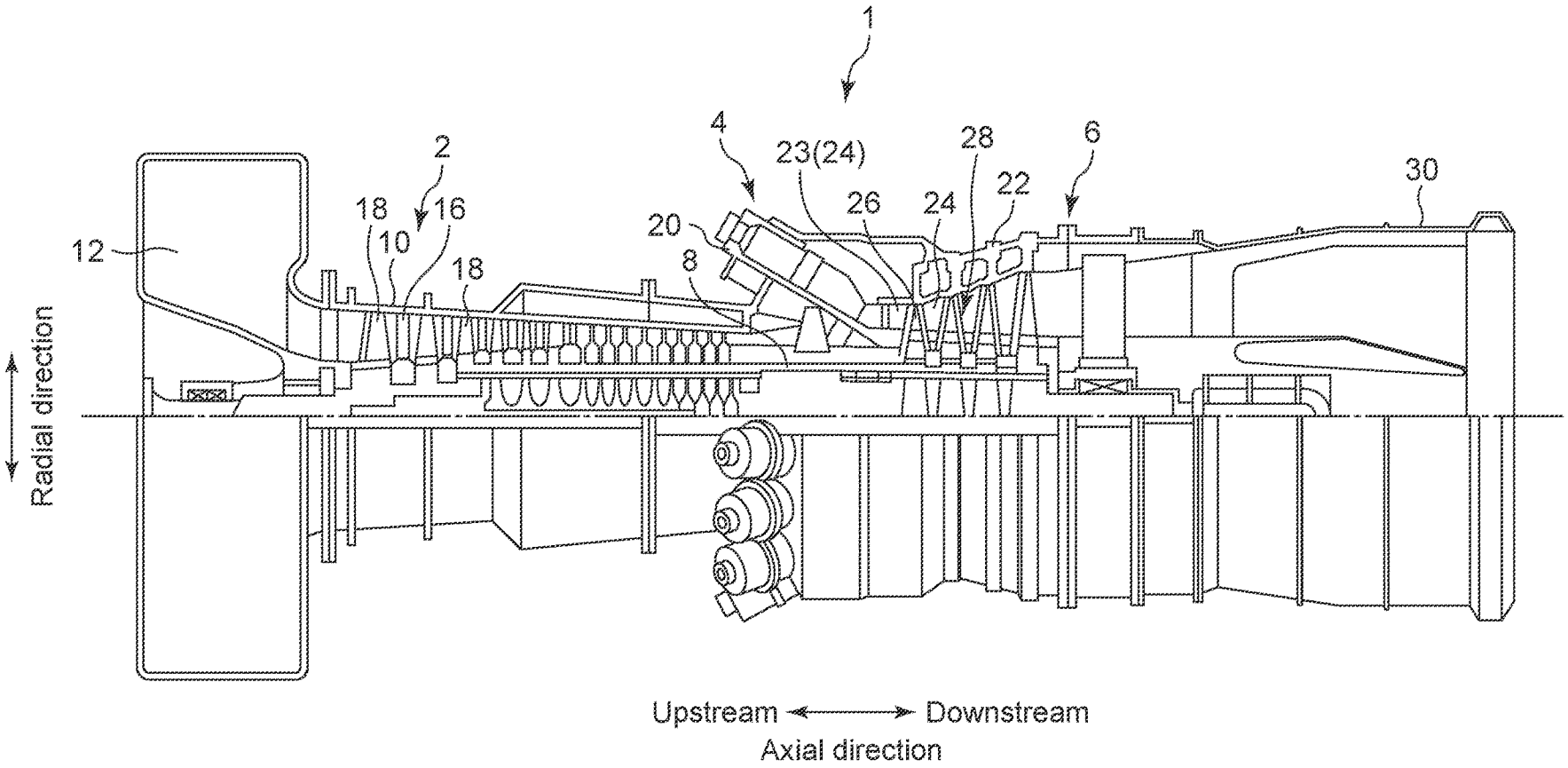
FIG. 1 is a schematic configuration diagram of a gas turbine according to an embodiment.

FIG. 1 is a schematic configuration diagram of a gas turbine according to an embodiment.

As shown in FIG. 1, the gas turbine 1 includes a compressor 2 for producing compressed air, a combustor 4 for producing combustion gas from the compressed air and fuel, and a turbine 6 configured to be rotationally driven by the combustion gas. In the case of the gas turbine 1 for power generation, a generator (not shown) is connected to the turbine 6.

The compressor 2 includes a plurality of stator blades 16 fixed to a compressor casing 10 and a plurality of rotor blades 18 implanted on a rotor shaft 8 so as to be arranged alternately with the stator blades 16.

To the compressor 2, air sucked in from an air inlet 12 is supplied. The air flows through the plurality of stator blades 16 and the plurality of rotor blades 18 to be compressed into compressed air having a high temperature and a high pressure.

The combustor 4 is supplied with fuel and the compressed air produced in the compressor 2. The combustor 4 combusts the fuel to produce combustion gas that serves as a working fluid of the turbine 6. As shown in FIG. 1, the gas turbine 1 has a plurality of combustors 4 arranged along the circumferential direction around the rotor inside a casing 20.

The turbine 6 has a combustion gas passage 28 formed by a turbine casing 22 and includes a plurality of turbine stator blades 24 and a plurality of turbine rotor blades 26 disposed in the combustion gas passage 28. The turbine stator blades 24 are fixed to the turbine casing 22, and a set of the turbine stator blades 24 arranged along the circumferential direction of the rotor shaft 8 forms a stator blade array. Further, the turbine rotor blades 26 are implanted on the rotor shaft 8, and a set of the turbine rotor blades 26 arranged along the circumferential direction of the rotor shaft 8 forms a rotor blade array. The stator blade arrays and the rotor blade arrays are arranged alternately in the axial direction of the rotor shaft 8.

In the turbine 6, as the combustion gas introduced from the combustor 4 into the combustion gas passage 28 passes through the plurality of turbine stator blades 24 and the plurality of turbine rotor blades 26, the rotor shaft 8 is rotationally driven. Thereby, the generator connected to the rotor shaft 8 is driven to generate power. The combustion gas having driven the turbine 6 is discharged outside via an exhaust chamber 30.

Hereinafter, the axial direction of the gas turbine 1 (axial direction of the rotor shaft 8) is referred to as merely "axial direction" or "axially", and the radial direction of the gas turbine 1 (radial direction of the rotor shaft 8) is referred to as merely "radial direction" or "radially", and the circumferential direction of the gas turbine 1 (circumferential direction of the rotor shaft 8) is referred to as merely "circumferential direction" or "circumferentially". Further, with respect to the flow direction of combustion gas in the combustion gas passage 28, the upstream side in the axial direction is referred to as merely "upstream", and the downstream side in the axial direction is referred to as merely "downstream".

Figure 2:
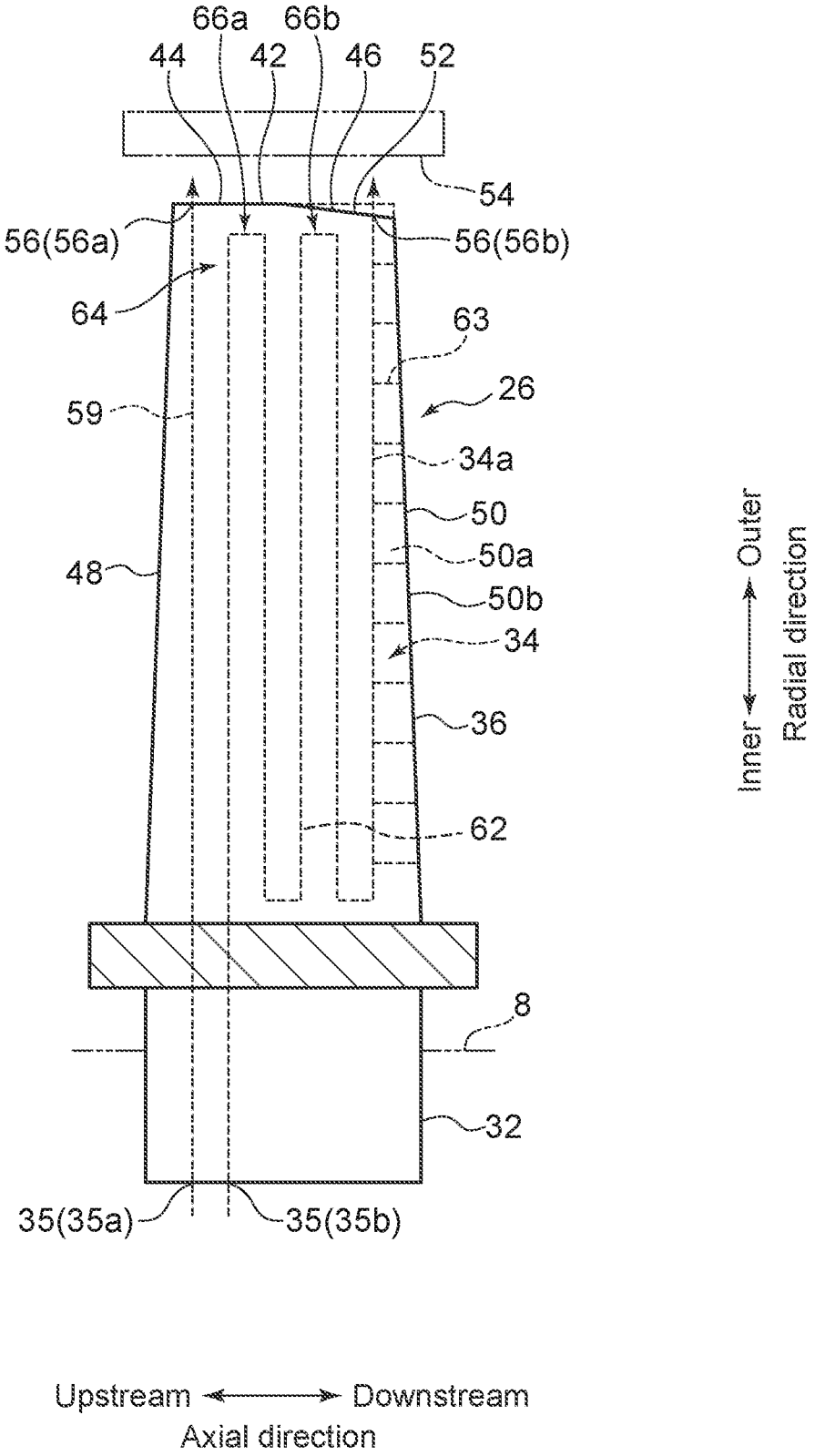
FIG. 2 is a schematic configuration diagram of a turbine rotor blade according to an embodiment.
Figure 3:
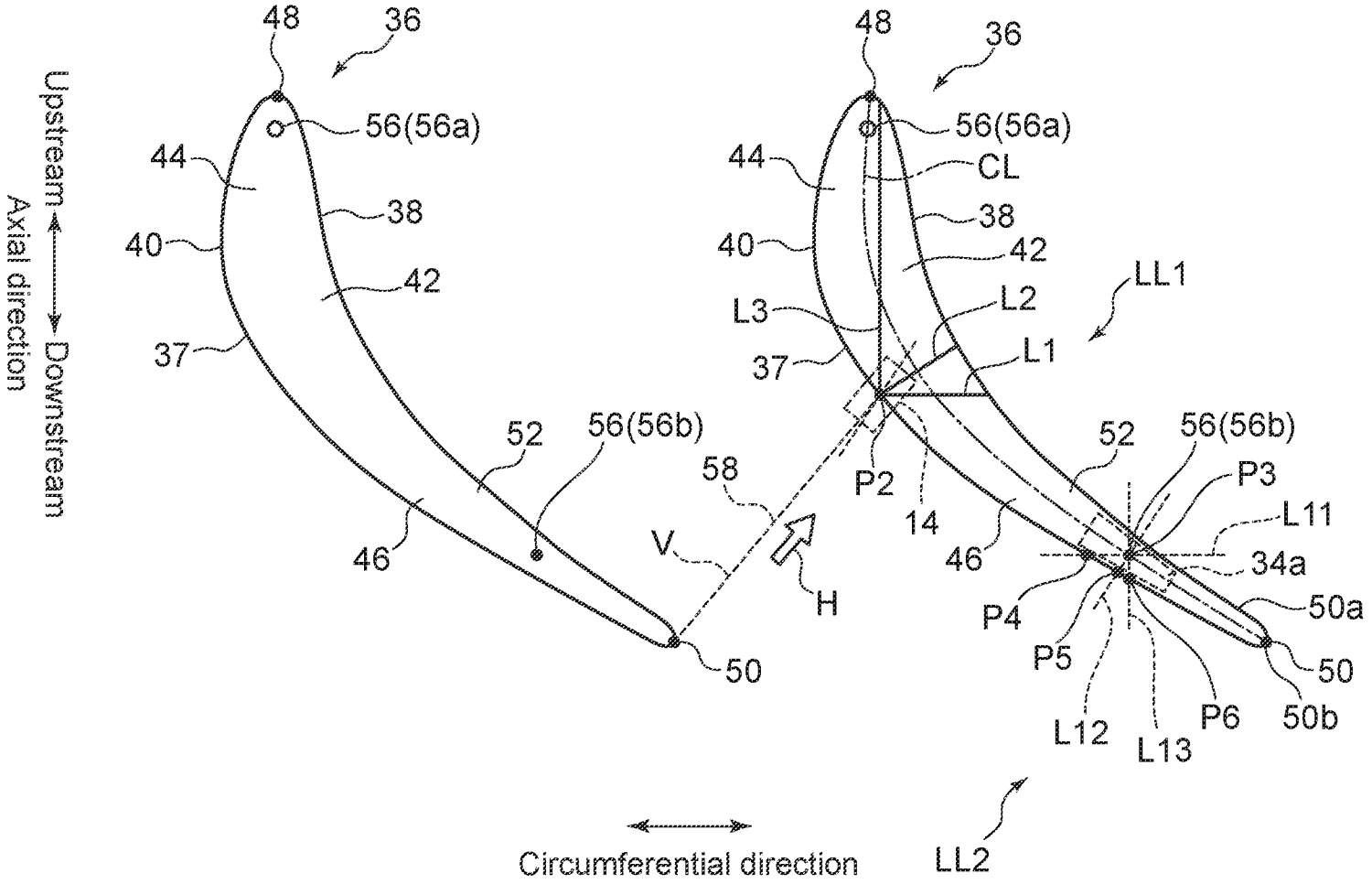
FIG. 3 is a configuration diagram of adjacent turbine rotor blades according to an embodiment when a rotor blade array is viewed from the radially outer side, where the most upstream boundary line and the most downstream boundary line are shown.

FIG. 2 is a schematic configuration diagram of the turbine rotor blade 26 according to an embodiment. FIG. 3 is a diagram of turbine rotor blades 26 which are adjacent to each other in the circumferential direction when the rotor blade array is viewed from the radially outer side.

As shown in FIG. 2, the turbine rotor blade 26 includes a root portion 32 fixed to the rotor shaft 8 and an airfoil portion 36 in which a cooling passage 34 is formed. Further, as shown in FIG. 3, the airfoil portion 36 includes a pressure surface 38, a suction surface 40, and a top surface 42 connecting the pressure surface 38 and the suction surface 40. The top surface 42 is arranged so as to face an annular stationary wall surface 54 (see FIG. 2) of the turbine casing 22 (see FIG. 1).

In some embodiments, for example as shown in FIGS. 2 and 3, the top surface 42 includes a leading edge region 44 located on the leading edge 48 side and formed parallel to the rotor shaft 8 (the axis of rotor shaft 8), and a trailing edge region 46 adjacent to the leading edge region 44 in the axial direction. Between the leading edge region 44 and the trailing edge region 46, a boundary line LL is formed. The trailing edge region 46 has an inclined surface 52 that is inclined with respect to the leading edge region 44 from the boundary line LL radially inward as it approaches the trailing edge 50.

In the case where the airfoil portion 36 of the gas turbine 1 is a rotor blade 26 having a flat top surface 42 parallel to the rotor shaft 8, during normal operation (for example, high-temperature state where the temperature of the turbine rotor blade rises during rated load operation), the turbine rotor blade 26 deforms due to centrifugal force, force received from the gas flow, and thermal expansion. In particular, the temperature of a coolant flowing through the cooling passage tends to increase in the vicinity of the trailing edge 50 of the turbine rotor blade 26 by heat-up due to heat input from the combustion gas, so that thermal expansion in the radial direction tends to be significant in the vicinity of the trailing edge 50. Accordingly, if the distance (hereinafter, referred to as "tip clearance") between the top surface 42 of the turbine rotor blade 26 and the stationary wall surface 54 of the turbine casing 22 is set to a constant value from the leading edge 48 to the trailing edge 50 when the operation of the gas turbine 1 is stopped (state where the temperature of the turbine rotor blade 26 does not rise and is close to room temperature), the risk of contact between the top surface 42 of the turbine rotor blade 26 and the stationary wall surface 54 of the turbine casing 22 increases at the trailing edge 50 which tends to thermally expand when the gas turbine 1 is operated.

However, if the airfoil portion 36 is formed such that the tip clearance during the stop of operation is increased uniformly from the leading edge 48 to the trailing edge 50 to prevent contact between the top surface 42 of the turbine rotor blade 26 and the stationary wall surface 54 of the turbine casing 22 on the trailing edge 50 side, the tip clearance is excessively increased on the leading edge side during normal operation of the gas turbine, so that the performance of the gas turbine decreases. That is, the temperature of a coolant flowing in the airfoil portion 36 is lower on the leading edge 48 side than on the trailing edge 50 side, and thermal expansion in the radial direction is suppressed to be relatively small on the leading edge 48 side, so that the clearance on the leading edge 48 side during normal operation of the gas turbine 1 tends to increase.

Therefore, when the tip height (the height from the center of the rotor shaft 8 to the top surface 42) is the same from the leading edge 48 to the trailing edge 50, the tip clearance on the leading edge 48 side during normal operation becomes relatively large compared to the trailing edge 50 side, and the leak flow of the combustion gas from the tip (top surface 42) increases on the leading edge 48 side, which causes a reduction in the aerodynamic performance of the turbine rotor blade 26.

To solve this, in the turbine rotor blade 26 shown in FIG. 2, the trailing edge region 46 disposed on the trailing edge 50 side which tends to thermally expand has an inclined surface 52 inclined radially inward toward the trailing edge 50. In other words, the trailing edge region 46 includes an inclined surface 52 that is inclined such that the tip clearance increases as it approaches the trailing edge 50 when the operation of the gas turbine is stopped. Thus, as shown by the dotted line in FIG. 2, the inclined surface 52 is formed such that the tip clearance of the top surface 42 is made uniform from the leading edge 48 to the trailing edge 50 as the trailing edge region 46 mainly deforms radially outward due to thermal expansion during normal operation of the gas turbine 1.

In addition, since the leading edge region 44 is formed parallel to the rotor shaft 8, in the leading edge region 44, the height from the center of the rotor shaft 8 to the top surface 42 (top plate 60) is uniform, and the tip clearance of the turbine rotor blade 26 is uniform over the leading edge region 44. Accordingly, when the tip clearance is measured with a measurement tool 14 such as a taper gauge, the tip clearance can be appropriately managed regardless of the position of the leading edge region 44, and the tip clearance can be easily managed. That is, in the leading edge region 44, since thermal expansion of the airfoil portion 36 in the radial direction is small, the amount of change in the tip clearance during normal operation is small, and the clearance between the top plate 60 (top surface 42) and the stationary wall surface 54 can be easily controlled to an appropriate amount. Accordingly, the loss due to the leak flow in the clearance between the top surface 42 and the stationary wall surface 54 in the leading edge region 44 can be effectively reduced.

As described above, the position of the optimum boundary line SLL which separates the leading edge region 44 and the trailing edge region 46 varies depending on the operating conditions and the blade structure of the turbine rotor blade 26, and it is necessary to select the optimum boundary line SLL that meets the conditions.

The basic concept of selecting the optimum boundary line SLL will now be described. The tip clearance is managed on the premise of the measurement of the clearance between the stationary wall surface 54 of the turbine casing 22 and the top surface of the turbine rotor blade 26. Specifically, in the case of the turbine rotor blade 26 in which the thermal expansion change of the airfoil portion 36 extends to a range close to the leading edge 48, the optimum boundary line SLL needs to be placed close to the leading edge 48, while in the case of the turbine rotor blade 26 in which thermal expansion is small, the boundary line may be placed close to the trailing edge 50.

However, in the case where the optimum boundary line SLL is placed close to the leading edge 48, there is a limit to the selection of the position to place the optimum boundary line SLL. More specifically, as described above, to measure the size of the clearance for the tip clearance management, it is necessary to apply a measurement tool perpendicularly to the blade surface 37, and if that is not possible, the size of the clearance cannot be accurately measured. As described later, when the clearance is measured in the vicinity of the leading edge 48, the throat position on the suction surface 40 of the blade surface 37 of the turbine rotor blade 26 is the most upstream measurable limit in the axial direction. If the measurement is performed axially upstream of this position, the adjacent rotor blade 26 become an obstacle, and the measurement cannot be accurately performed. As shown in FIG. 3, the perpendicular line V descending from the trailing edge 50 (trailing edge end portion 50*a*) of the adjacent turbine blade 26 to the suction surface 40 corresponds to a throat 58 between the suction surface 40 and the adjacent turbine blade 26. The intersection between the perpendicular line V and the suction surface 40 is the position P2 of the throat on the suction surface 40. The temporary boundary line that passes through the position P2 and separates the leading edge region 44 and the trailing edge region 46 is referred to as a virtual line. The virtual line formed closest to the leading edge 48 is selected as the most upstream virtual line (first virtual line) LL1.

There are innumerable most upstream virtual lines LL1 passing through the position P2, but in terms of the ease of forming the boundary line LL on the top surface 42, it is limited to a certain range. The virtual line L1 shown in FIG. 3 is the most upstream circumferential virtual line passing through the position P2, perpendicular to the rotor shaft 8, and extending in the circumferential direction. The virtual line L2 is the most upstream camber perpendicular virtual line passing through the position P2 and perpendicular to the camber line CL. The virtual line L3 is the most upstream rotor axial virtual line passing through the position P2 and extending along the rotor shaft 8. Each virtual line starts from the position P2, extends linearly through the position P2, and intersects the blade surface 37 at both ends.

Of the three virtual lines, the virtual line L3 is the most upstream virtual line LL1 closest to the leading edge 48. The most upstream virtual line LL1 is located in a range defined by the virtual line L1, the virtual line L2, and the virtual line L3, and can be selected in a range from the virtual line L1 (most upstream circumferential virtual line) to the virtual line L3 (most upstream rotor axial virtual line) in a counterclockwise direction.

Next, the selection of the most downstream virtual line LL2 assumed as another virtual line defining the optimum boundary line SLL will be described. As described later in detail, the straight line passing through the position P3, which is the position of an outlet opening 56 arranged near the trailing edge 50 shown in FIG. 3, corresponds to the most downstream virtual line (second virtual line) LL2. The airfoil portion 36 in the vicinity of the outlet opening 56 has a structure that is most easily extended in the radial direction. The virtual line L11 shown in FIG. 3 is the most downstream circumferential virtual line passing through the position P3, perpendicular to the rotor shaft 8, and extending in the circumferential direction. The virtual line L12 is the most downstream camber perpendicular virtual line passing through the position P3 and perpendicular to the camber line CL. The virtual line L13 is the most downstream rotor axial virtual line passing through the position P3 and extending along the rotor shaft 8. The most downstream virtual line LL2 is located in a range defined by the virtual line L11, the virtual line L12, and the virtual line L13, and can be selected in a range from the virtual line L11 (most downstream circumferential virtual line) to the virtual line L13 (most downstream rotor axial virtual line) in a counterclockwise direction.

Figure 4:
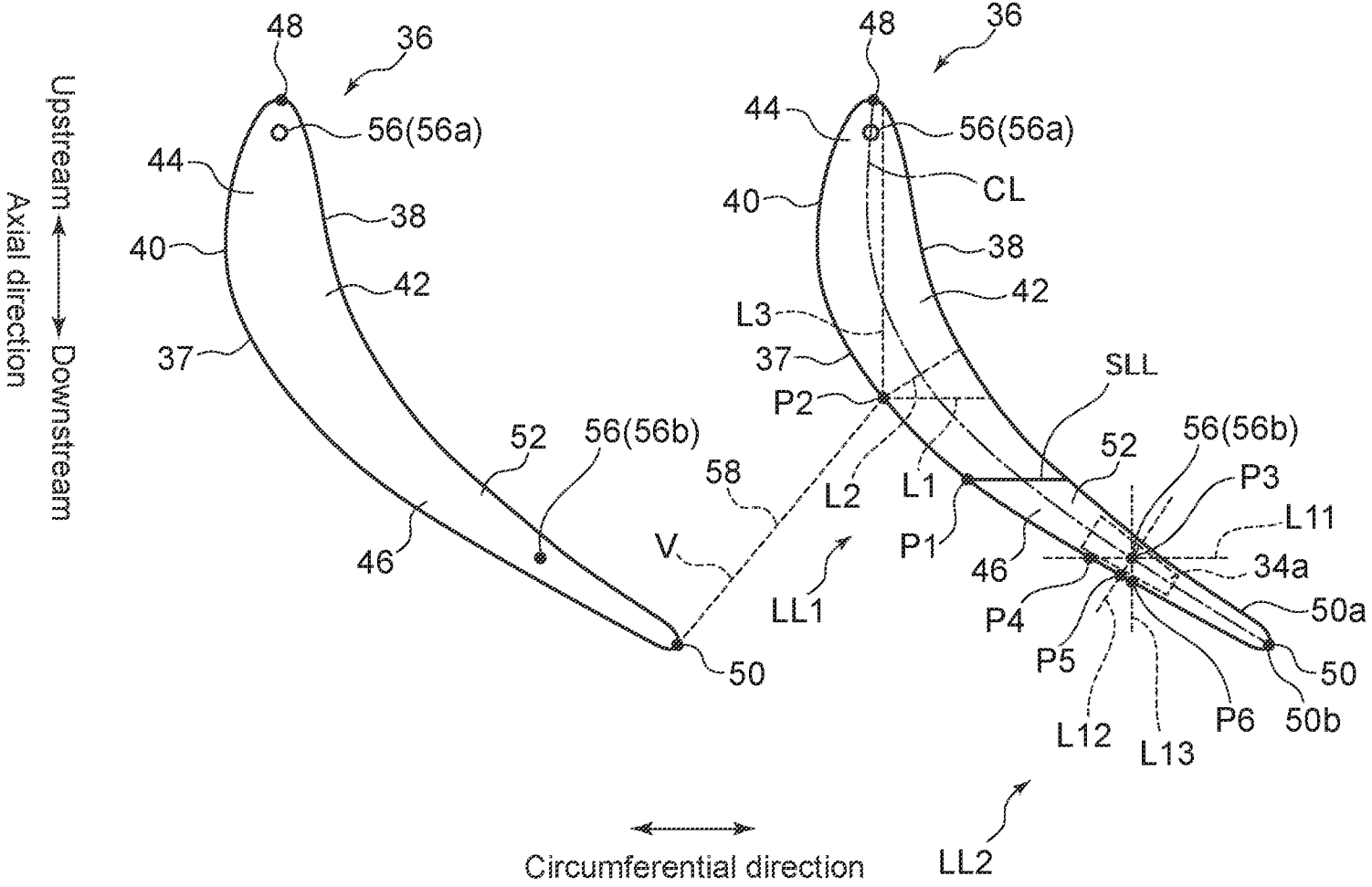
FIG. 4 is a configuration diagram showing the optimum boundary line, the most upstream boundary line, and the most downstream boundary line according to an embodiment.

The amount of thermal expansion of the turbine rotor blade 26 varies depending on the blade structure, operating conditions, and the position of the airfoil portion 36. FIG. 4 shows an example in which the optimum boundary line SLL is formed between the most upstream virtual lines L1, L2, L3 and the most downstream virtual lines L11, L12, L13. In the example shown in FIG. 4, the circumferential virtual line passing through the position P1, perpendicular to the rotor shaft 8, and extending in the circumferential direction is shown as an example of the optimum boundary line SLL.

In the following, details will be described based on the basic concept described above.

In some embodiments, for example as shown in FIG. 3, the position of the intersection between the virtual lines L1, L2, L3 and the suction surface 40 is the position P2 at which the throat 58 is formed between the suction surface 40 and the adjacent turbine rotor blade 26. The expression "position at which the throat 58 is formed between the suction surface 40 and the adjacent turbine rotor blade 26" means the position P2 which is the intersection between the suction surface 40 and the perpendicular line V descending from the trailing edge 50 of the adjacent turbine blade 26 to the suction surface 40 and indicates the position of the throat 58 on the suction surface 40.

In order to accurately measure the tip clearance, it is desirable to insert a measurement tool 14 such as a taper gauge into a clearance between the top surface 42 and the stationary wall surface 54 along the perpendicular line V, i.e., in the direction perpendicular to the suction surface 40, from a side of the suction surface 40 of the turbine rotor blade 26. In order to accurately measure the size of the clearance, it is desirable to apply the measurement tool 14 perpendicularly to the blade surface (suction surface 40) of the measurement point. That is, when the measurement tool 14 is applied from the adjacent turbine rotor blade 26 side to measure the size of the tip clearance, the position closest to the leading edge 48 on the suction surface 40 from the leading edge 48 to the trailing edge 50 is the position P2 of the throat 58 on the suction surface 40. At a position closer to the leading edge 48 than this position P2, the adjacent rotor blade 26 becomes an obstacle, and the measurement tool 14 cannot be applied perpendicularly to the suction surface 40, so that it is difficult to accurately measure the size of the clearance.

In some embodiments, for example as shown in FIG. 3, the virtual line passing through the position P2 defines the most upstream virtual line LL1 closest to the leading edge 48. As described above, as the most upstream virtual line LL1, the virtual lines L1, L2, L3 can be selected. The virtual line L1 is a virtual line perpendicular to the rotor shaft 8 and extending linearly along the circumferential direction to separate the leading edge region 44 on the leading edge 48 side from the trailing edge region 46 on the trailing edge 50 side.

If the virtual line L1 is set in the direction perpendicular to the rotor shaft 8, the virtual line L1 can be easily positioned. Therefore, when the top surface 42 is configured such that the virtual line L1 between the leading edge region 44 and the trailing edge region 46 extends along the circumferential direction perpendicular to the rotor shaft 8, the virtual line L1 between the leading edge region 44 and the trailing edge region 46 can be formed at an accurate position on the top surface 42, and the size of the tip clearance between the top plate 60 (top surface 42) and the stationary wall surface 54 can be accurately managed.

The virtual line L2 is a camber perpendicular virtual line passing through the position P2 and extending linearly in the direction perpendicular to the camber line CL. Since the virtual line L2 is a straight line perpendicular to the camber line CL, the positioning is easy, and the boundary line can be easily processed.

The virtual line L3 is a rotor axial virtual line passing through the position P2 and extending linearly along the direction of the rotor shaft 8. Since the virtual line L3 is a straight line extending parallel to the rotor shaft 8 in the direction of the rotor shaft 8, the positioning is easy, and the boundary line can be easily processed.

Next, the selection of the most downstream virtual line LL2 will be described.

In some embodiments, for example as shown in FIGS. 2 and 3, the cooling passage 34 forms a serpentine passage 62 which will be described later, and a coolant having passed through the last cooling passage 34*a* closest to the trailing edge 50 is discharged from an outlet opening 56 formed on the top surface 42. The outlet opening 56 is formed in the top plate 60 at the radially outer end of the last cooling passage 34*a*, and is directly connected to the last cooling passage 34*a*. A part of the coolant is discharged to the combustion gas through a plurality of radially arranged cooling holes diverging from the last cooling passage 34*a* and opening to a trailing edge end surface 50*b* of an end portion 50*a* of the trailing edge 50 facing axially downstream. In the process of discharging the coolant to the combustion gas through the plurality of cooling holes 63, the end portion 50*a* of the trailing edge 50 is cooled to prevent thermal damage to the trailing edge end portion 50*a*.

Although the airfoil portion 36 in the vicinity of the outlet opening 56 closest to the trailing edge 50 is intensively cooled in various ways to prevent the heat-up of the coolant, thermal expansion in the radial direction is still significant in this portion. Therefore, the virtual lines L11, L12, L13 passing through the position P3, which is the central position of the outlet opening 56*b*, are formed as a part of the most downstream virtual line LL2. As shown by the dotted line in FIG. 3, the position P3 of the outlet opening 56*b* is formed in the cross-section of the last cooling passage 34*a* when the blade cross-section is viewed from the radially outer side.

The virtual line L11 is a circumferential virtual line passing through the position P3, perpendicular to the rotor shaft 8, and extending in the circumferential direction. The intersection between the suction surface 40 and the virtual line L11 is the position P4. Since the virtual line L11 is a straight line perpendicular to the rotor shaft 8, the positioning is easy, and the boundary line can be easily processed.

The virtual line L12 is a camber perpendicular virtual line passing through the position P3 and extending linearly in the direction perpendicular to the camber line CL. The intersection between the suction surface 40 and the virtual line L12 is the position P5. Since the virtual line L12 is a straight line perpendicular to the camber line CL, the positioning is easy, and the boundary line can be easily processed.

The virtual line L13 is a rotor axial virtual line passing through the position P3 and extending linearly along the direction of the rotor shaft 8. The intersection between the suction surface 40 and the virtual line L13 is the position P6. Since the virtual line L13 is a straight line extending parallel to the rotor shaft 8 in the direction of the rotor shaft 8, the positioning is easy, and the boundary line can be easily processed.

As described above, as the most downstream virtual line LL2, a boundary line LL between the most downstream circumferential virtual line L11 and the most downstream rotor axial virtual line L13 is preferably selected. That is, it is desirable that the most downstream virtual line LL2 is selected in a range from the virtual line L11 (most downstream circumferential virtual line) to the virtual line L13 (most downstream rotor axial virtual line) in a counterclockwise direction.

FIG. 4 is a configuration diagram showing an example of the optimum boundary line SLL selected based on the blade structure and operating conditions, the most upstream virtual line LL1 which is a limit of the optimum boundary line SLL on the axially upstream side, and the most downstream virtual line LL2 which is a limit on the axially downstream side on the top surface 42 of the turbine rotor blade 26. The optimum boundary line SLL is formed between the most upstream virtual line LL1 and the most downstream virtual line LL2. In selecting the optimum boundary line SLL, the tip clearance (size of clearance) is estimated in consideration of the blade structure, operating conditions, etc., and the position P1 and the optimum boundary line SLL are selected.

In FIG. 4, it is desirable that the position P1 on the axially upstream side close to the leading edge 48 coincides with at least the position P2, or the P1 is located between the P2 and the trailing edge 50. Further, it is desirable that the position P1 on the axially downstream side close to the trailing edge 50 coincides with the position P4 which is the intersection with the virtual line L11 (most downstream circumferential virtual line), or is located between the P4 and the leading edge 48. Alternatively, it is desirable that the position P1 coincides with the position P5 which is the intersection with the virtual line L12 (most downstream camber perpendicular virtual line), or is located between the P5 and the leading edge 48. Alternatively, it is desirable that the position P1 coincides with the position P6 which is the intersection with the virtual line L13 (most downstream rotor axial virtual line), or is located between the P6 and the leading edge 48. When such a position P1 is set so that a predetermined boundary line LL formed between the most upstream virtual line LL1 and the most downstream virtual line LL2 is selected as the optimum boundary line SLL, the tip clearance between the leading edge region 44 and the stationary wall surface 54 can be easily and accurately measured. Further, when an accurate optimum boundary line SLL can be formed, an accurate tip clearance (size of clearance) can be selected, so that the leak flow of the combustion gas from the top surface 42 can be suppressed. Further, a measurement tool 14 such as a taper gauge can be smoothly inserted into the clearance between the leading edge region 44 and the stationary wall surface 54 without interfering with the trailing edge 50 of the adjacent turbine blade 26.

As described above, in the vicinity of the outlet opening 56*b* of the cooling passage 34 closest to the trailing edge 50, particularly, thermal expansion tends to be significant, so that the risk of contact between the top surface 42 and the stationary wall surface 54 increases. Therefore, as described above, when the position P1 is located between the position P4, which is the intersection with the virtual line L11, and the leading edge 48, the contact risk between the top surface 42 and the stationary wall surface 54 in the vicinity of the outlet opening 56*b* can be effectively reduced.

In some embodiments, for example as shown in FIG. 3, when P5 is the position of the intersection between the suction surface 40 and the straight line L3 passing through the position P3 and parallel to the circumferential direction on the top surface 42, the position P1 is located between the position P5 and the leading edge 48 of the airfoil portion 36.

In the vicinity of the outlet opening 56*b* of the cooling passage 34 closest to the trailing edge 50, the temperature of the coolant flowing through the serpentine passage 62 is heated up by heat input from the combustion gas. Thus, particularly, thermal expansion tends to be significant, so that the risk of contact between the top surface 42 and the stationary wall surface 54 increases. Therefore, as described above, when the position P1 is located between the position P5, which is the intersection with the virtual line L12, and the leading edge 48, the leak flow of the combustion gas from the top surface 42 (inclined surface 52) of the turbine rotor blade 26 can be suppressed while effectively reducing the contact risk between the top surface 42 and the stationary wall surface 54.

In the vicinity of the outlet opening 56*b* of the cooling passage 34 closest to the trailing edge 50, particularly, radially outward thermal expansion tends to be significant, so that the risk of contact between the top surface 42 and the stationary wall surface 54 increases. Therefore, as described above, when the position P1 is located between the position P6, which is the intersection with the virtual line L13, and the leading edge 48, the contact risk between the top surface 42 and the stationary wall surface 54 in the vicinity of the outlet opening 56*b* can be effectively reduced.

In the case of selecting the optimum boundary line SLL, in consideration of the positions of the most upstream virtual line LL1 and the most downstream virtual line LL2, the position P1 of the boundary line LL may be selected based on the distribution of the estimated clearance size, the virtual line passing through the position P1 may be selected based on the distribution of the clearance size in the leading edge region 44 and the trailing edge region 46, and this virtual line may be used as the optimum boundary line SLL.

Figure 5:
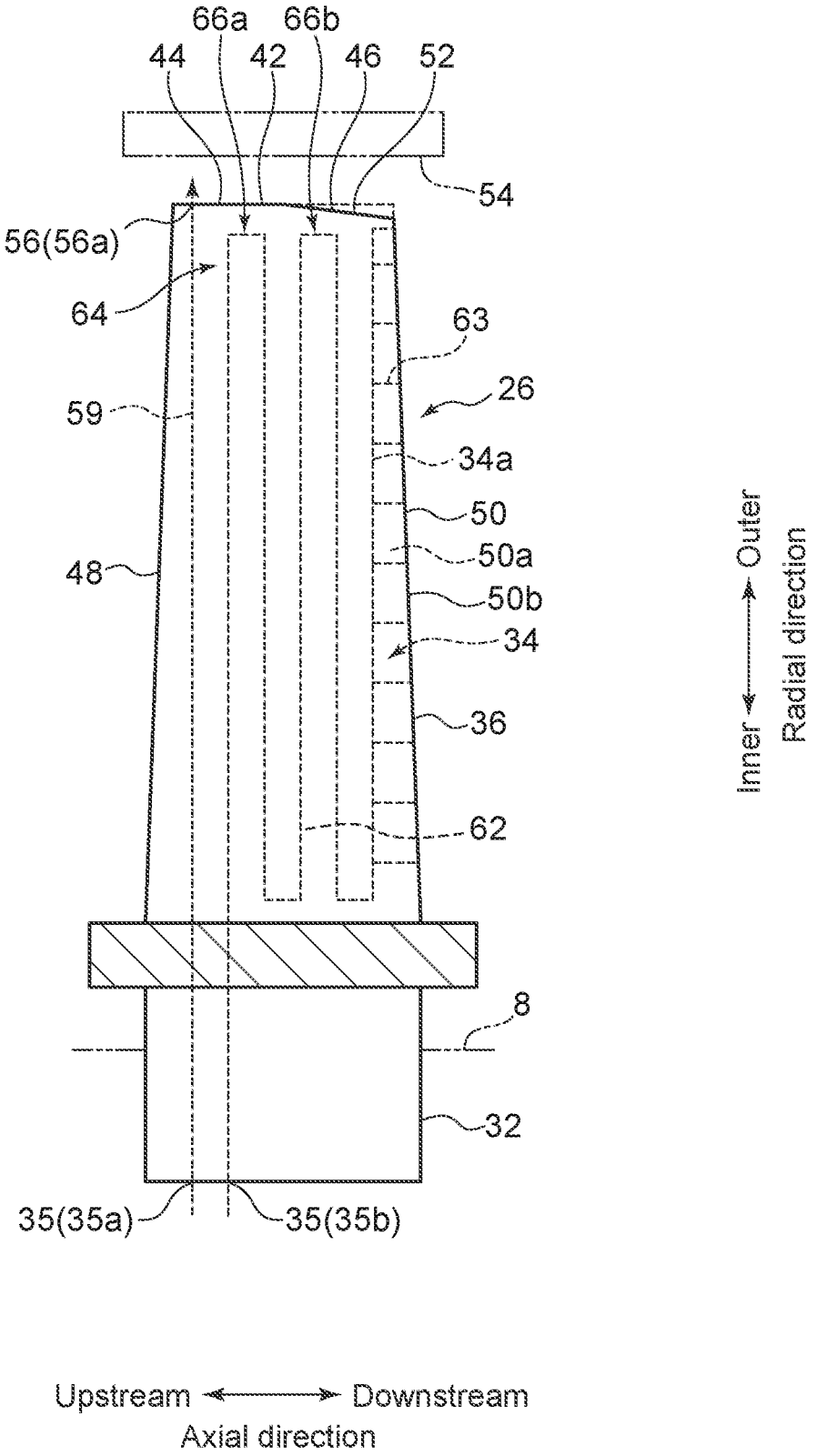
FIG. 5 is a schematic configuration diagram of a turbine rotor blade according to another embodiment.
Figure 6:
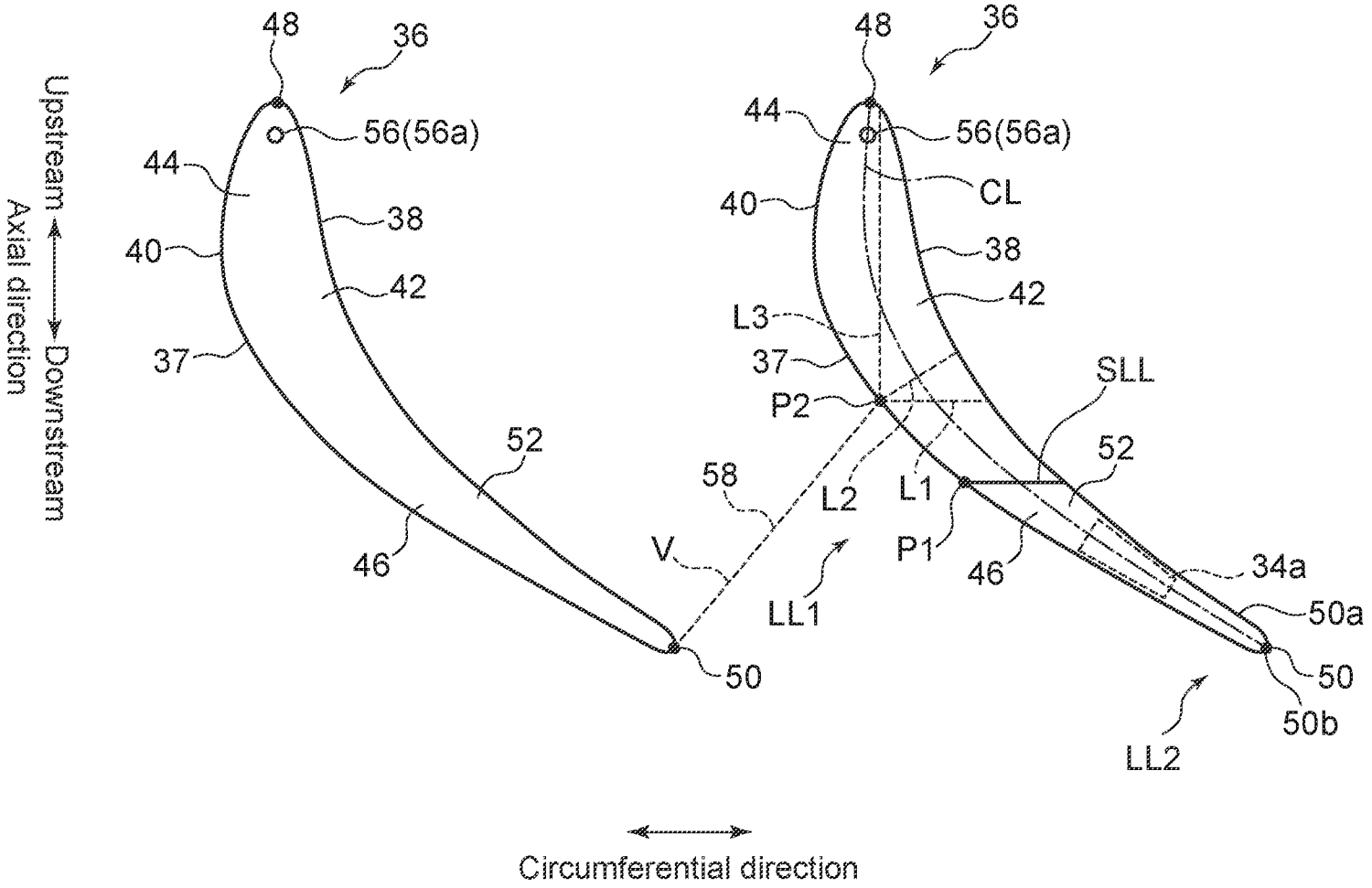
FIG. 6 is a configuration diagram showing the optimum boundary line and the most upstream boundary line according to another embodiment.

In some embodiments, as shown in FIGS. 5 and 6, the trailing edge 50 of the turbine rotor blade 26 has no outlet opening for the coolant. FIG. 5 is a schematic configuration diagram of the turbine rotor blade according to another embodiment. FIG. 6 is a configuration diagram showing the optimum boundary line SLL and the most upstream boundary line LL1 according to another embodiment. The cooling passage 34 formed inside the airfoil portion 36 of the turbine rotor blade 26 forms the serpentine passage 62. The radially outer end of the last cooling passage 34*a* closest to the trailing edge 50 has no outlet opening formed on the top surface 42 and directly connected to the last cooling passage 34*a* as described above. The last cooling passage 34*a* is connected to a plurality of radially arranged cooling holes 63 communicating at one end with the upstream cooling passage 34 of the last cooling passage 34*a* and opening at the other end to the trailing edge end portion 50*a* of the trailing edge 50 which faces axially downstream. All of the coolant supplied to the last cooling passage 34*a* flows from the last cooling passage 34*a* to the cooling holes 63, and in the process of discharging the coolant to the combustion gas from the trailing edge end portion 50*a*, the trailing edge end portion 50*a* of the trailing edge 50 is convection-cooled to prevent thermal damage to the trailing edge end portion 50*a*.

In the airfoil portion 36 in the vicinity of the radially outer end of the last cooling passage 34*a*, the coolant is heated up in the process of flowing through the serpentine passage 62. Accordingly, the vicinity of the trailing edge end portion 50*a* on the top surface 42 side near the cooling hole 63 connected to the last cooling passage 34*a* on the radially outer side is most overheated in the airfoil portion 36 although it is cooled by the coolant, so that thermal expansion in the radially outward direction is the most significant.

As shown in FIG. 6, in this embodiment, the optimum boundary line SLL is formed between the most upstream virtual line LL1, which is the upper limit, located on the axially upstream side and the most downstream virtual line LL2, which is the lower limit, corresponding to the trailing edge end portion 50*a* (substantially corresponding to the trailing edge end surface 50*b*). Preferably, the position P1 where the optimum boundary line SLL intersects the suction surface 40 coincides with at least the position P2, or the P1 is located between the P2 and the trailing edge 50. Further, the position P1 defining the lower limit of the optimum boundary line SLL coincides with the position of the trailing edge end portion 50*a*, as described above. Incidentally, as shown by the dotted line in FIG. 6, an outlet opening for the coolant is not formed on the top surface 42 in the cross-section of the last cooling passage 34*a* on the trailing edge 50 side when the blade cross-section is viewed from the radially outer side. The coolant flows through the cooling hole 63 and is discharged from the opening of the trailing edge end portion 50*b*.

When such a position P1 is set so that a predetermined boundary line LL formed between the most upstream virtual line LL1 and the most downstream virtual line LL2 is selected as the optimum boundary line SLL, a measurement tool 14 such as a taper gauge can be smoothly inserted into the clearance between the leading edge region 44 and the stationary wall surface 54 without interfering with the trailing edge 50 of the adjacent turbine blade 26. As a result, the tip clearance between the leading edge region 44 and the stationary wall surface 54 can be easily and accurately measured. Further, when an accurate optimum boundary line SLL can be formed, an accurate tip clearance (size of clearance) can be selected, so that the leak flow of the combustion gas from the top surface 42 can be suppressed.

Figure 7:
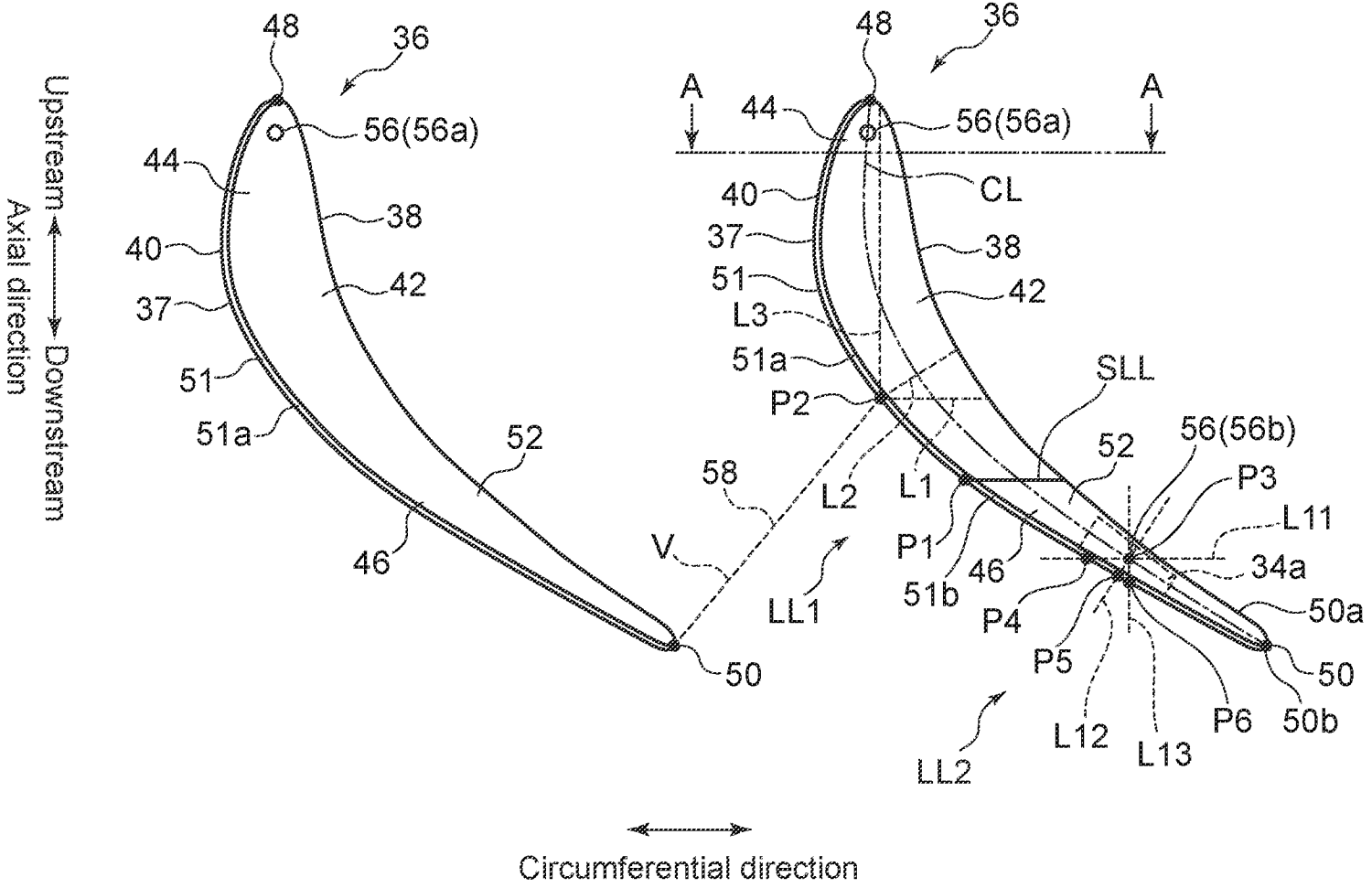
FIG. 7 is a schematic configuration diagram of a turbine rotor blade according to another embodiment.
Figure 8:
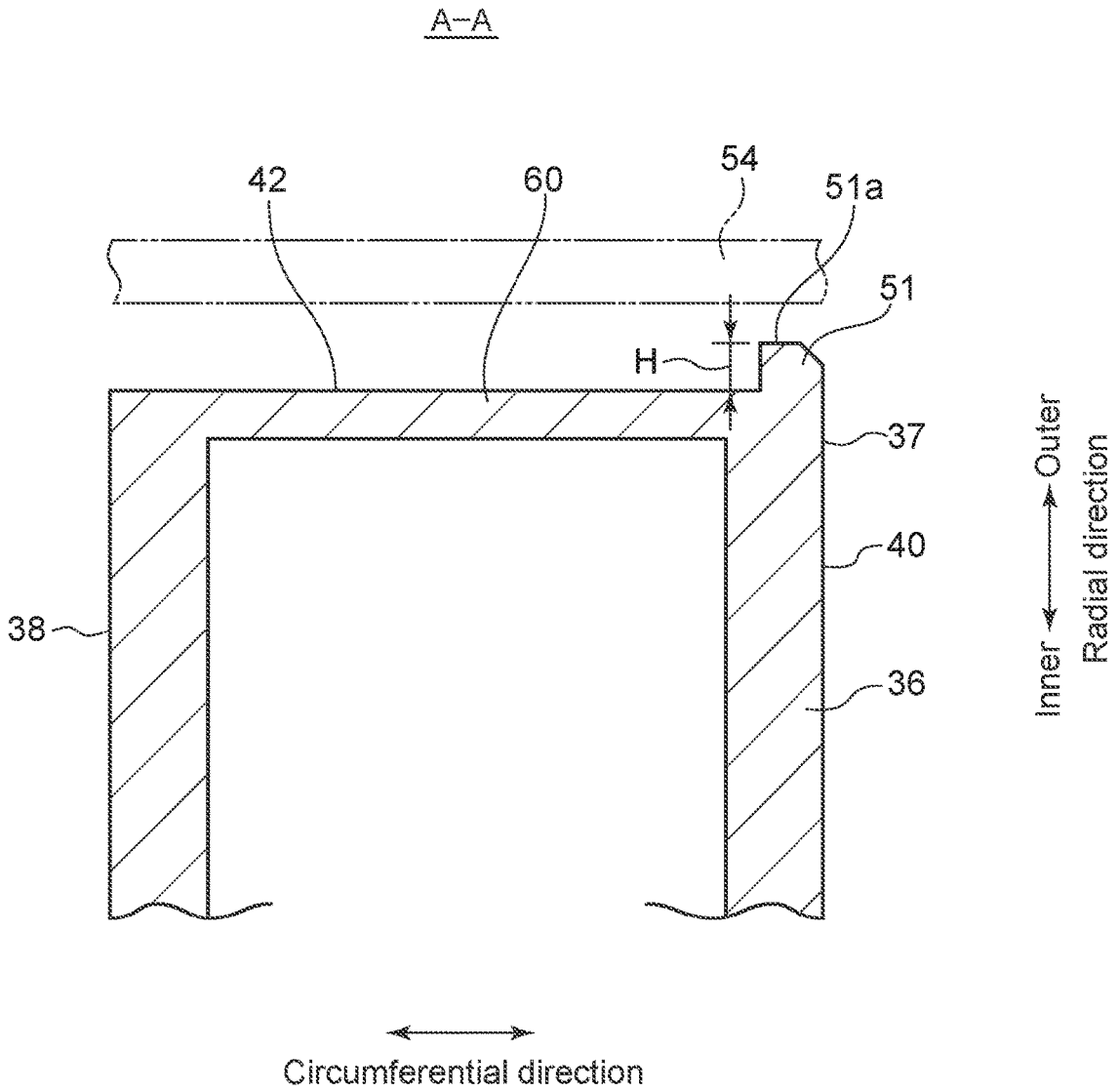
FIG. 8 is a cross-sectional view taken along line A-A in FIG. 7.

FIG. 7 is a plan view showing the structure of the top surface 42 of the turbine rotor blade 26 according to another embodiment. FIG. 8 is a cross-sectional view of the turbine rotor blade 26 according to the embodiment when viewed from the axial direction, taken along line A-A in FIG. 7.

In some embodiments, for example as shown in FIGS. 7 and 8, the turbine rotor blade 26 includes a protrusion 51 (also referred to as tip thinning or squealer) formed along the blade surface 37 from the leading edge 48 to the trailing edge 50 at a circumferentially end portion of the top surface on the suction surface 40 side so as to protrude radially outward from the top surface 42.

As shown in FIG. 8, the protrusion 51 is formed so as to protrude radially outward at a height H from the top surface 42 along the blade surface 37 on the suction surface 40 side of the turbine rotor blade 26, and extends from the leading edge 48 to the trailing edge 50.

Also in this embodiment, for example as shown in FIGS. 7 and 8, the top surface 42 includes a leading edge region 44 located on the leading edge 48 side and formed parallel to the rotor shaft 8, and a trailing edge region 46 adjacent to the leading edge region 44 in the axial direction. The trailing edge region 46 has an inclined surface 52 that is inclined with respect to the leading edge region 44 radially inward as it approaches the trailing edge 50.

As shown in FIG. 8, the protrusion 51 extending along the blade surface 37 on the suction surface 40 side on the top surface 42 is formed from the leading edge 48 to the trailing edge with a constant height H from the top surface 42 in the radially outward direction. That is, the leading edge region 44 and the trailing edge region 46 formed on the top surface 42 are also formed on a planar top portion 51*a* facing radially outward of the protrusion 51 adjacent in the circumferential direction.

In this embodiment, the measurement of the clearance between the stationary wall surface 54 and the airfoil portion 36 of the turbine rotor blade 26 is performed by measuring the clearance between the stationary wall surface 54 and the top portion 51*a* of the protrusion 51 formed on the suction surface 40 side. Accordingly, the position P2 corresponding to the throat position is formed on the top portion 51*a* of the protrusion 51. Also in this embodiment, the virtual line passing through the position P2 on the top portion 51*a* of the protrusion 51 defines the most upstream virtual line LL1 closest to the leading edge 48, and the virtual lines L1, L2, L3 are selected as the most upstream virtual line LL1. Specifically, the virtual lines L1, L2, L3 correspond to the most upstream circumferential direction L1 perpendicular to the rotor shaft 8, the most upstream camber perpendicular virtual line L2 perpendicular to the camber line CL, and the most upstream rotor axial virtual line L3 extending parallel to the rotor shaft 8.

However, the most upstream virtual line LL1 is located in a range defined by the virtual line L1, the virtual line L2, and the virtual line L3, and can be selected in a range from the virtual line L1 (most upstream circumferential virtual line) to the virtual line L3 (most upstream rotor axial virtual line) in a counterclockwise direction.

The most upstream virtual line LL1 extending linearly from the position P2 formed along the blade surface 37 of the top portion 51*a* of the protrusion 51 to the position of the other blade surface 37 is also formed on the top surface 42.

In some embodiments, for example as shown in FIGS. 7 and 8, when P3 is the central position of the outlet opening 56*b* of the last cooling passage 34*a* formed on the top surface 42, the virtual line passing through the position P3 forms the most downstream virtual line. The circumferential virtual line L11 perpendicular to the rotor shaft 8 and linearly extending in the circumferential direction, the camber perpendicular virtual line L12 perpendicular to the camber line CL, and the rotor axial virtual line L13 extending parallel to the rotor shaft 8 are formed as a part of the most downstream virtual line LL2. Preferably, the most downstream virtual line LL2 is selected in a range from the virtual line L11 (most downstream circumferential virtual line) to the virtual line L13 (most downstream rotor axial virtual line) in a counterclockwise direction. The most downstream virtual line LL2 is formed on the top surface 42 and also on the top portion 51*a* of the protrusion 51.

FIG. 7 shows an example of the optimum boundary line SLL in the present embodiment. The optimum boundary line SLL formed on the top surface 42 is also formed on the top portion 51*a* of the protrusion 51 at the same position along the blade surface 37.

Accordingly, the height H of the top portion 51*a* of the protrusion 51 from the top surface 42 is kept constant from the leading edge 48 to the trailing edge 50. In selecting the optimum boundary line SLL, the tip clearance (size of clearance) is estimated in consideration of the blade structure, operating conditions, etc., and the position P1 and the direction in which the optimum boundary line SLL extends are selected.

The leading edge region 44 and the trailing edge region 46 formed on the top surface 42 with the optimum boundary line SLL as a boundary are also formed on the top portion 51*a* of the protrusion 51. The position of the boundary line LL between the leading edge region 44 and the trailing edge region 46 formed on the top surface 42 coincides with the position P1 of the boundary line LL between the leading edge region 44 and the trailing edge region 46 formed on the top portion 51*a* of the protrusion 51 in the direction along the radial direction of the blade surface 37. Accordingly, the leading edge region 44 on the top surface 42 and the leading edge region 44 on the top portion 51*a* of the protrusion 51 are formed parallel to the rotor shaft 8. Further, as with the trailing edge region 46 on the top surface 42, the trailing edge region 46 on the top portion 51*a* of the protrusion 51 has an inclined surface 51*b* that is inclined radially inward toward the trailing edge 50 in a direction from the position of the optimum boundary line SLL to the trailing edge 50. Also in this case, as described above, the height H of the top portion 51*a* of the protrusion 51 from the top surface 42 is kept constant from the leading edge 48 to the trailing edge 50.

With the configuration of the present embodiment, since the protrusion 51 is formed on the suction surface 40 side on the top surface 42 of the airfoil portion 36, the clearance between the top portion 51*a* of the protrusion 51 and the stationary wall surface 54 is reduced. Thus, the leak flow of the combustion gas over the top portion 51*a* of the protrusion 51 is reduced, and the aerodynamic performance of the turbine is improved.

Since the shape of the top portion 51*a* of the protrusion 51 along the blade surface 37 from the leading edge 48 to the trailing edge 50 is the same as that of the top surface 42, the leak flow of the combustion gas is reduced, and interference with the stationary wall surface 54 is avoided, so that the gas turbine 1 can be stably operated.

Figure 9:
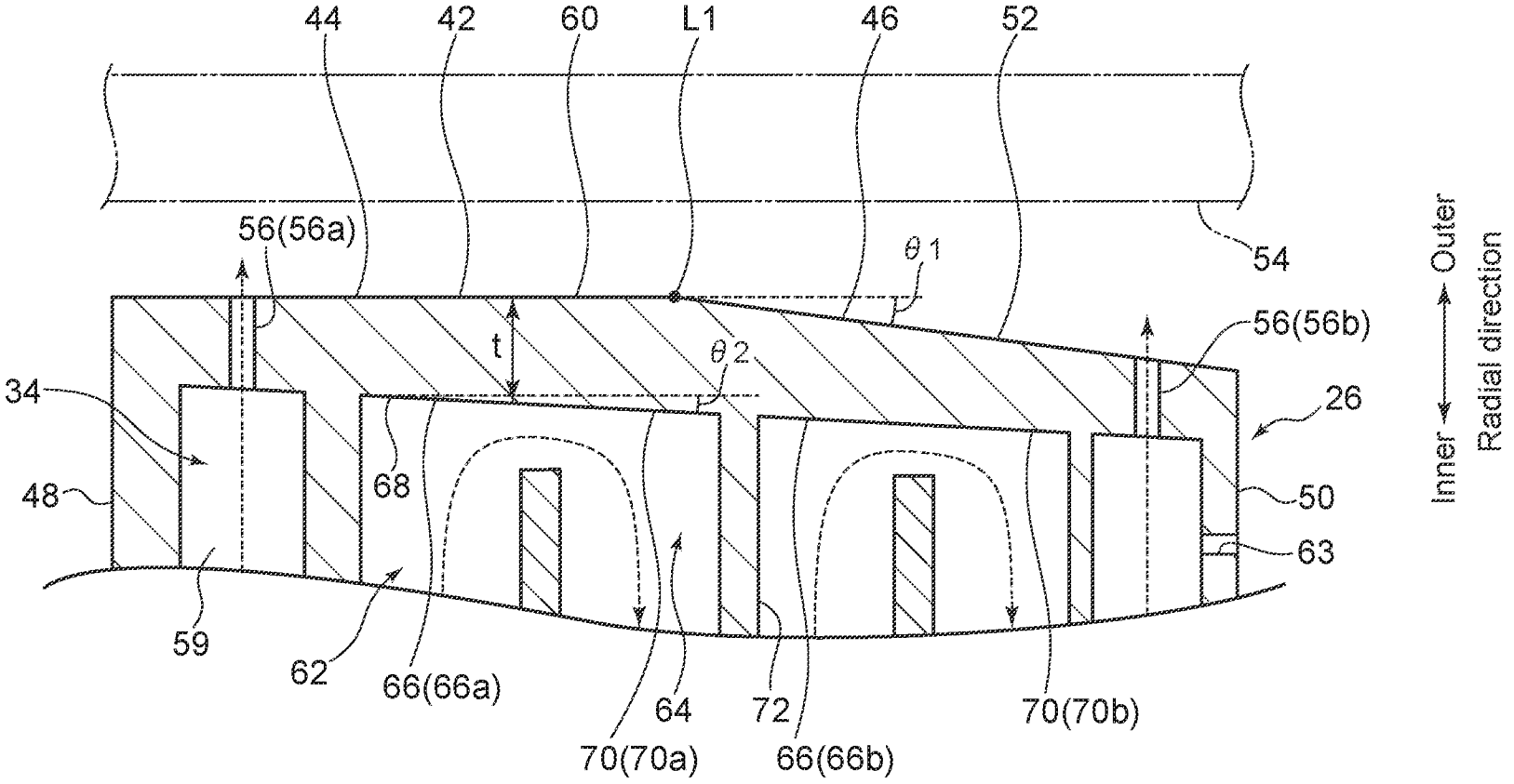
FIG. 9 is a cross-sectional view showing an exemplary configuration of the airfoil portion according to an embodiment.
Figure 10:
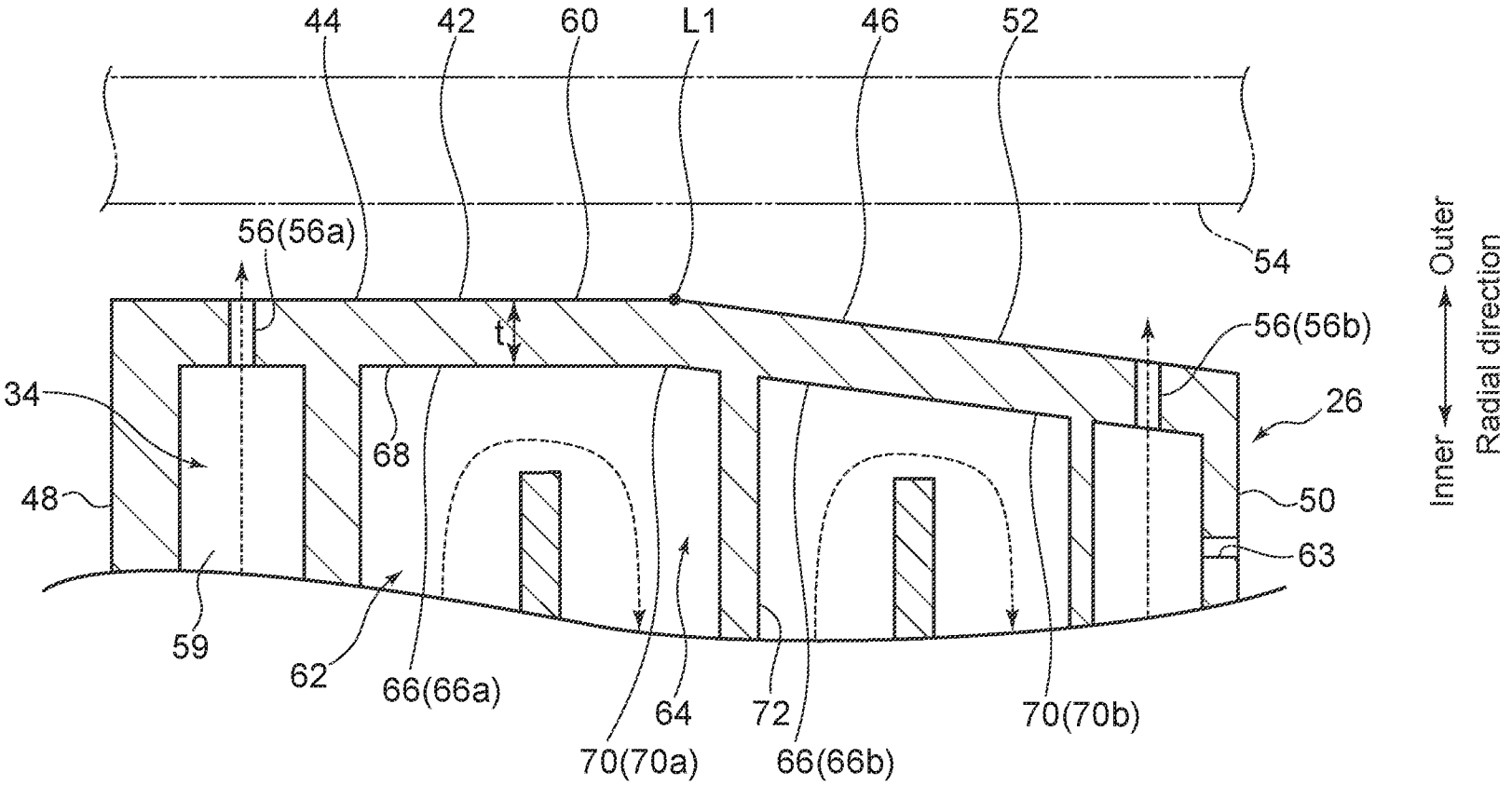
FIG. 10 is a cross-sectional view showing another configuration of the airfoil portion according to an embodiment.
Figure 11:
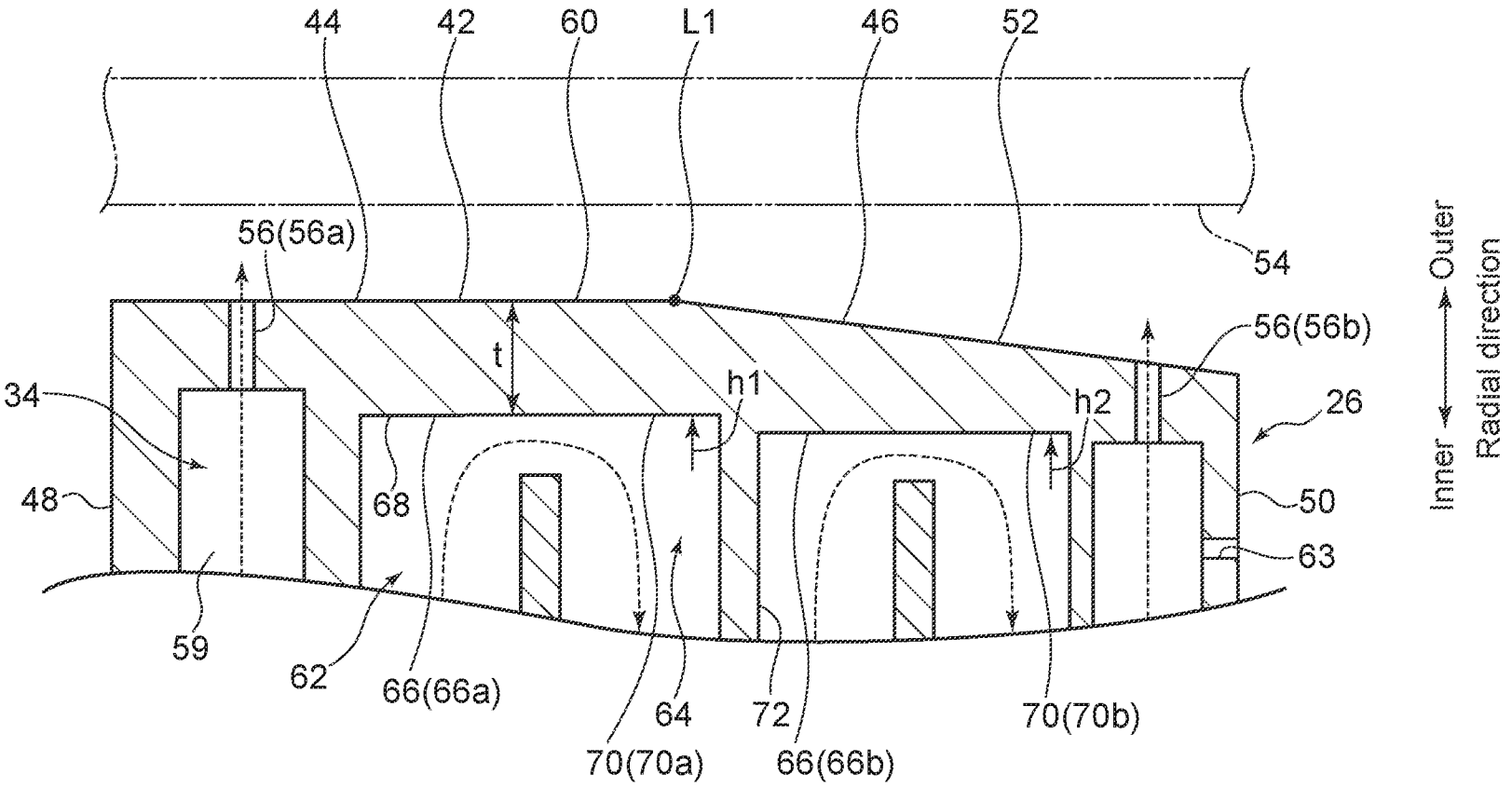
FIG. 11 is a cross-sectional view showing another configuration of the airfoil portion according to an embodiment.

FIG. 9 is a cross-sectional view showing an exemplary configuration of the airfoil portion 36 according to an embodiment. FIG. 10 is a cross-sectional view showing another configuration of the airfoil portion 36 according to an embodiment. FIG. 11 is a cross-sectional view showing another configuration of the airfoil portion 36 according to an embodiment.

In some embodiments, for example as shown in FIGS. 9 to 11, the airfoil portion 36 includes a top plate 60 forming the top surface 42.

In some embodiments, for example as shown in FIG. 9, the thickness t of the top plate 60 increases toward the trailing edge 50 in a range corresponding to at least a part of the leading edge region 44. Additionally, the thickness t of the top plate 60 decreases toward the trailing edge 50 in a range corresponding to at least a part of the trailing edge region 46. In the illustrated exemplary embodiment, the top plate 60 is configured such that the thickness t increases toward the trailing edge 50 in the entire range of the leading edge region 44, and the thickness t decreases toward the trailing edge 50 in the entire range of the trailing edge region 46.

With this configuration, the change in the thickness t of the top plate 60 from the leading edge 48 to the trailing edge 50 is small, and the temperature in the leading edge region 44 and the trailing edge region 46 is made uniform, so that the increase in the metal temperature of the top plate 60 is suppressed.

In some embodiments, for example as shown in FIG. 10, the top plate 60 is formed so as to have the same thickness t in both the leading edge region 44 and the trailing edge region 46.

With this configuration, since the thickness of the top plate is uniform from the leading edge region to the trailing edge region of the airfoil portion 36, the occurrence of thermal stress in the top plate can be suppressed.

In some embodiments, for example as shown in FIGS. 2 and 9 to 11, the cooling passage 34 includes a straight passage 59 disposed in the vicinity of the leading edge 48. The straight passage 59 includes an inlet opening 35*a* disposed on the root portion 32 and an outlet opening 56*a* disposed on the top surface 42, and extends in one direction along the radial direction inside the airfoil portion 36.

In some embodiments, for example as shown in FIGS. 2 and 9 to 11, the cooling passage 34 includes the serpentine passage 62 disposed from the leading edge 48 side to the trailing edge 50 side. In the illustrated exemplary embodiment, the serpentine passage 62 includes an inlet opening 35*b* disposed on the root portion 32 on the leading edge 48 side and the above-described outlet opening 56*b* disposed on the top surface 42 on the trailing edge 50 side, and meanders while folding back in the radial direction between the inlet opening 35*b* and the outlet opening 56*b*. The radially outer end portion 64 of the serpentine passage 62 includes at least one return portion 66 (66*a*, 66*b*) for reversing the flow of the coolant. In the illustrated exemplary embodiment, the radially outer end portion 64 of the serpentine passage 62 includes a first return portion 66*a* and a second return portion 66*b* for reversing the flow.

As shown in FIGS. 9 to 11, a wall surface 68 of the top plate 60 on the radially inner side opposite to the top surface 42 includes at least one return portion forming wall surface 70 (70*a*, 70*b*) forming a return portion 66. In the illustrated embodiment, the wall surface 68 of the top plate 60 on the radially inner side opposite to the top surface 42 includes a first return portion forming wall surface 70*a* forming a first return portion 66*a*, and a second return portion forming wall surface 70*b* forming a second return portion 66*b*. The second return portion forming wall surface 70*b* is adjacent to the trailing edge 50 side of the first return portion forming wall surface 70*a*, with a partition wall 72 interposed between the first and second return portion forming wall surfaces.

In some embodiments, for example as shown in FIG. 9, each return portion forming wall surface 70 (70*a*, 70*b*) is inclined radially inward toward the trailing edge 50. In the illustrated embodiment, $\theta 1 > \theta 2$ is satisfied, where $\theta 1$ is an inclination angle of the inclined surface 52 with respect to the axial direction, and $\theta 2$ is an inclination angle of each return portion forming wall surface 70 (70*a*, 70*b*) with respect to the axial direction.

With this configuration, even when the inclined surface 52 inclined radially inward toward the trailing edge 50 is formed, since the return portion forming wall surface 70 (70*a*, 70*b*) is inclined radially inward toward the trailing edge 50, the thickness of the top plate 60 on the trailing edge 50 side which tends to thermally expand can be easily made uniform.

In some embodiments, for example as shown in FIG. 11, each of the first return portion forming wall surface 70*a* and the second return portion forming wall surface 70*b* is formed parallel to the rotor shaft 8, and the height h1 of the first return portion forming wall surface 70*a* from the rotor shaft 8 is more than the height h2 of the second return portion forming wall surface 70*b* from the rotor shaft 8. That is, the inner wall surface 68 of the top plate 60 opposite to the top surface 42 is stepped such that the height from the rotor shaft 8 decreases toward the downstream side.

With this configuration, even when the inclined surface 52 inclined radially inward toward the trailing edge 50 is formed, since the height h1 of the first return portion forming wall surface 70*a* from the rotor shaft 8 is more than the height h2 of the second return portion forming wall surface 70*b* from the rotor shaft 8, the thickness of the top plate 60 on the trailing edge 50 side which tends to thermally expand can be easily made uniform, so that the occurrence of thermal stress can be suppressed.

The present invention is not limited to the embodiments described above, but includes modifications to the embodiments described above, and embodiments composed of combinations of those embodiments.

REFERENCE SIGNS LIST

1 Gas turbine
2 Compressor
4 Combustor
6 Turbine
8 Rotor shaft
10 Compressor casing
12 Inlet

14 Measurement tool
16 Stator blade
18 Rotor blade
22 Turbine casing
24 Turbine stator blade
26 Turbine rotor blade
28 Combustion gas passage
30 Exhaust chamber
32 Root portion
34 Cooling passage
35 (35*a*, 35*b*) Inlet opening
36 Airfoil portion
37 Blade surface
38 Pressure surface
40 Suction surface
42 Top surface
44 Leading edge region
46 Trailing edge region
48 Leading edge
50 Trailing edge
50*a* Trailing edge end portion
50*b* Trailing edge end surface
51 Protrusion
51*a* Top portion
52, 51*b* Inclined surface
54 Stationary wall surface
56 (56*a*, 56*b*) Outlet opening
58 Throat
59 Straight passage
60 Top plate
62 Serpentine passage
63 Cooling hole
64 Radially outer end portion
66 Return portion
66*a* First return portion
66*b* Second return portion
68 Inner wall surface
70 Return portion forming wall surface
70*a* First return portion forming wall surface
70*b* Second return portion forming wall surface
72 Partition wall
LL Boundary line (Virtual line)
SLL Optimum boundary line
LL1 Most upstream virtual line (First virtual line)
LL2 Most downstream virtual line (Second virtual line)
L1 First circumferential virtual line (Most upstream virtual line)
L2 First camber perpendicular virtual line (Most upstream virtual line)
L3 First rotor axial virtual line (Most upstream virtual line)
L11 Second circumferential virtual line (Most downstream virtual line)
L12 Second camber perpendicular virtual line (Most downstream virtual line)
L13 Second rotor axial virtual line (Most downstream virtual line)

The invention claimed is:

1. A turbine rotor blade, comprising:
a root portion fixed to a rotor shaft; and
an airfoil portion including a pressure surface, a suction surface, and a top surface connecting the pressure surface and the suction surface, with a cooling passage formed inside the airfoil portion,
wherein the top surface includes a leading edge region located on a leading edge side and a trailing edge region adjacent to the leading edge region,
wherein the trailing edge region has an inclined surface inclined with respect to the leading edge region radially inward toward a trailing edge,
wherein, on the top surface, when P1 is a position of an intersection between the suction surface and a boundary line between the leading edge region and the trailing edge region, and P2 is a position on the suction surface at which a throat is formed between the suction surface and a trailing edge of an adjacent turbine rotor blade,
the position P1 coincides with the position P2 or is located between the position P2 and the trailing edge of the airfoil portion.

2. The turbine rotor blade according to claim 1,
wherein the leading edge region is formed parallel to the rotor shaft.

3. The turbine rotor blade according to claim 1,
wherein the top surface has at least one outlet opening centered at a position P3,
wherein, on the top surface, a first virtual line located on the leading edge side and passing through the position P2 and a second virtual line located on the trailing edge side and passing through the position P3 are selected,
wherein the first virtual line is located in a range defined by a first circumferential virtual line passing through the position P2 and extending in a circumferential direction, a first camber perpendicular virtual line passing through the position P2 and extending in a direction perpendicular to a camber line, and a first rotor axial virtual line passing through the position P2 and extending in a rotor axial direction,
wherein the second virtual line is located in a range defined by a second circumferential virtual line passing through the position P3 and extending in the circumferential direction, a second camber perpendicular virtual line passing through the position P3 and extending in the direction perpendicular to the camber line, and a second rotor axial virtual line passing through the position P3 and extending in the rotor axial direction, and
wherein the boundary line is a straight line passing through the position P1 and is formed on the top surface between the first virtual line and the second virtual line.

4. The turbine rotor blade according to claim 3,
wherein when P4 is a position of an intersection between the suction surface and the second circumferential virtual line,
the position P1 is located between the position P4 and the leading edge of the airfoil portion.

5. The turbine rotor blade according to claim 3,
wherein when P5 is a position of an intersection between the suction surface and the second camber perpendicular virtual line,
the position P1 is located between the position P5 and the leading edge of the airfoil portion.

6. The turbine rotor blade according to claim 3,
wherein when P6 is a position of an intersection between the suction surface and the second rotor axial virtual line,
the position P1 is located between the position P6 and the leading edge of the airfoil portion.

7. The turbine rotor blade according to claim 1,
wherein the boundary line extends along a direction perpendicular to the rotor shaft.

8. The turbine rotor blade according to claim 1,
wherein the boundary line extends along an axial direction of the rotor shaft.

9. The turbine rotor blade according to claim 1, wherein the boundary line extends along a direction perpendicular to a camber line.

10. The turbine rotor blade according to claim 1, wherein a protrusion protruding radially outward from the top surface is formed along a blade surface at a suction-side end portion of the top surface in a circumferential direction, and a height of a top portion of the protrusion from the top surface in a radial direction is constant from the leading edge to the trailing edge.

11. The turbine rotor blade according to claim 1, wherein the airfoil portion includes a top plate forming the top surface, wherein a thickness of the top plate increases toward the trailing edge in a range corresponding to at least a part of the leading edge region, and wherein the thickness of the top plate decreases toward the trailing edge in a range corresponding to at least a part of the trailing edge region.

12. The turbine rotor blade according to claim 1, wherein the airfoil portion includes a top plate forming the top surface, and wherein the top plate is formed so as to have the same thickness in the leading edge region and the trailing edge region.

13. The turbine rotor blade according to claim 1, wherein the airfoil portion includes a top plate forming the top surface, wherein the cooling passage includes a serpentine passage arranged from the leading edge side to the trailing edge side, wherein a radially outer end portion of the serpentine passage includes at least one return portion for reversing a flow, wherein a wall surface of the top plate opposite to the top surface includes at least one return portion forming wall surface forming the at least one return portion, and wherein the at least one return portion forming wall surface is inclined radially inward toward the trailing edge.

14. The turbine rotor blade according to claim 1, wherein the airfoil portion includes a top plate forming the top surface, wherein the cooling passage includes a serpentine passage arranged from the leading edge side to the trailing edge side, wherein a radially outer end portion of the serpentine passage includes a first return portion and a second return portion for reversing a flow, wherein a wall surface of the top plate opposite to the top surface includes a first return portion forming wall surface forming the first return portion, and a second return portion forming wall surface forming the second return portion, the second return portion forming wall surface being adjacent to the trailing edge side of the first return portion forming wall surface, with a partition wall interposed between the first and second return portion forming wall surfaces, wherein each of the first return portion forming wall surface and the second return portion forming wall surface is formed parallel to the rotor shaft, and wherein a height of the first return portion forming wall surface from the rotor shaft is more than a height of the second return portion forming wall surface from the rotor shaft.

15. A turbine, comprising:

a rotor shaft;

the turbine rotor blade according to claim 1; and an annular stationary wall surface facing the top surface of the turbine rotor blade.

16. A tip clearance measurement method for measuring a tip clearance between a top surface of a turbine rotor blade and a stationary wall surface of a turbine, wherein the top surface includes a leading edge region located on a leading edge side, and a trailing edge region inclined such that a distance from the stationary wall surface increases toward a trailing edge, and wherein, on the top surface, when P1 is a position of an intersection between the suction surface and a boundary line between the leading edge region and the trailing edge region, and P2 is a position on the suction surface at which a throat is formed between the suction surface and a trailing edge of an adjacent turbine rotor blade, the position P1 coincides with the position P2 or is located between the position P2 and the trailing edge of the airfoil portion, wherein the tip clearance measurement method comprises a leading edge region measurement step of measuring a tip clearance between the leading edge region and the stationary wall surface.

17. The tip clearance measurement method according to claim 16, wherein the leading edge region measurement step includes measuring the tip clearance between the leading edge region and the stationary wall surface from a suction side of the turbine rotor blade.

18. The tip clearance measurement method according to claim 16, wherein the leading edge region is formed parallel to the stationary wall surface.

* * * * *